US009205954B2

(12) United States Patent
Huang et al.

(10) Patent No.: US 9,205,954 B2
(45) Date of Patent: Dec. 8, 2015

(54) PORTABLE CUP HOLDER

(71) Applicants: Chen-Cheng Huang, Taipei (TW); Pao-Hao Huang, Taipei (TW); Pao-Han Huang, Taipei (TW)

(72) Inventors: Chen-Cheng Huang, Taipei (TW); Pao-Hao Huang, Taipei (TW); Pao-Han Huang, Taipei (TW)

( * ) Notice: Subject to any disclaimer, the term of this patent is extended or adjusted under 35 U.S.C. 154(b) by 0 days.

(21) Appl. No.: 14/285,772

(22) Filed: May 23, 2014

(65) Prior Publication Data

US 2014/0346183 A1 Nov. 27, 2014

(30) Foreign Application Priority Data

May 24, 2013 (TW) ..... 102118440 A

(51) Int. Cl.

| | |
|---|---|
| ***B65D 25/28*** | (2006.01) |
| ***B65D 81/38*** | (2006.01) |
| ***A47G 23/02*** | (2006.01) |
| ***A45F 5/00*** | (2006.01) |
| ***A45F 3/04*** | (2006.01) |
| ***A45F 3/14*** | (2006.01) |

(52) U.S. Cl.

CPC ..... *B65D 25/285* (2013.01); *A45F 3/04* (2013.01); *A45F 3/047* (2013.01); *A45F 5/00* (2013.01); *A47G 23/0216* (2013.01); *B65D 81/3876* (2013.01); *A45F 2003/142* (2013.01); *A45F 2005/006* (2013.01)

(58) Field of Classification Search

USPC ..... 220/738, 754, 770, 737, 739, 758, 220/23.83, 23.87, 903; 224/148.6, 148.1, 224/257, 259; 229/402; 215/396, 399; 294/31.2; 206/217; 190/115

See application file for complete search history.

(56) References Cited

U.S. PATENT DOCUMENTS

| | | | | |
|---|---|---|---|---|
| 1,839,636 | A * | 1/1932 | Baker | 294/27.1 |
| 4,305,584 | A * | 12/1981 | Leehan | 473/127 |
| 5,954,247 | A * | 9/1999 | Savine et al. | 224/148.4 |
| 2005/0057056 | A1* | 3/2005 | Davis | 294/152 |
| 2007/0138217 | A1* | 6/2007 | Hranilovich | 224/148.6 |
| 2009/0126149 | A1* | 5/2009 | Whittaker | 16/111.1 |
| 2010/0032457 | A1* | 2/2010 | Field et al. | 224/148.1 |

* cited by examiner

*Primary Examiner* — Jeffrey Allen
*Assistant Examiner* — Jennifer Castriotta
(74) *Attorney, Agent, or Firm* — Nixon & Vanderhye P.C.

(57) ABSTRACT

A portable cup holder includes: a cup-holding unit including a first cup-embracing wall that is formed with two first wall holes and a second cup-embracing wall that is formed with two second wall holes aligned with the first wall holes; and a handle string unit including first and second string parts, each of which extends from outside of the cup-holding space through one of the first wall holes into the cup-holding space and then through one of the second wall holes to the outside of the cup-holding space and then extends therefrom through the other of the second wall holes into the cup-holding space and then through the other of the first wall holes to the outside of the cup-holding space. Each of the first and second string parts is shiftable along a transverse direction.

6 Claims, 10 Drawing Sheets

PORTABLE CUP HOLDER

CROSS-REFERENCE TO RELATED APPLICATION

This application claims priority of Taiwanese Application No. 102118440, filed on May 24, 2013.

BACKGROUND OF THE INVENTION

1. Field of the Invention

This invention relates to a portable cup holder, more particularly to a portable cup holder including a handle string unit extending through a cup-holding unit.

2. Description of the Related Art

U.S. Patent Application Publication No. 2009/0126149 discloses a conventional convertible cup holder including a cup holder that is adapted to hold a cup and that is formed with a top sleeve, and a string that extends into the top sleeve and that is deployable to form handles which are extendable above the cup holder. The string is coiled inside the top sleeve, permitting the handles to be pulled to a predetermined length. The conventional convertible cup holder is disadvantageous in that it requires the top sleeve to position the string, which complicates the structure of the conventional convertible cup holder. In addition, by virtue of the connection between the handles and the cup holder, the conventional convertible cup holder may undesirably swing during carrying and may not be able to constantly maintain the cup in an upright position.

SUMMARY OF THE INVENTION

Therefore, an object of the present invention is to provide a portable cup holder that can overcome the aforesaid drawbacks associated with the prior art.

According to this invention, there is provided a portable cup holder that comprises: a cup-holding unit including curved first and second cup-embracing walls that are diametrically disposed with respect to a central axis of the cup-holding unit, the cup-holding unit defining a cup-holding space between the first and second cup-embracing walls, and a top opening that is in spatial communication with the cup-holding space and that is adapted for extension of a cup therethrough and into the cup-holding space, the first cup-embracing wall being formed with a pair of spaced-apart first wall holes that are spaced apart from the top opening, the second cup-embracing wall being formed with a pair of spaced-apart second wall holes that are spaced apart from the top opening and that are aligned with the first wall holes along a transverse direction, respectively; and a handle string unit including first and second string parts, each of which is formed into a loop-shaped structure and each of which extends from outside of the cup-holding space through one of the first wall holes into the cup-holding space and then through one of the second wall holes to the outside of the cup-holding space and then continuously extends therefrom through the other of the second wall holes into the cup-holding space and then through the other of the first wall holes to the outside of the cup-holding space. Each of the first and second string parts is shiftable relative to the cup-holding unit along the transverse direction.

BRIEF DESCRIPTION OF THE DRAWINGS

In drawings which illustrate embodiments of the invention.

DETAILED DESCRIPTION OF THE PREFERRED EMBODIMENTS

Figure 1:
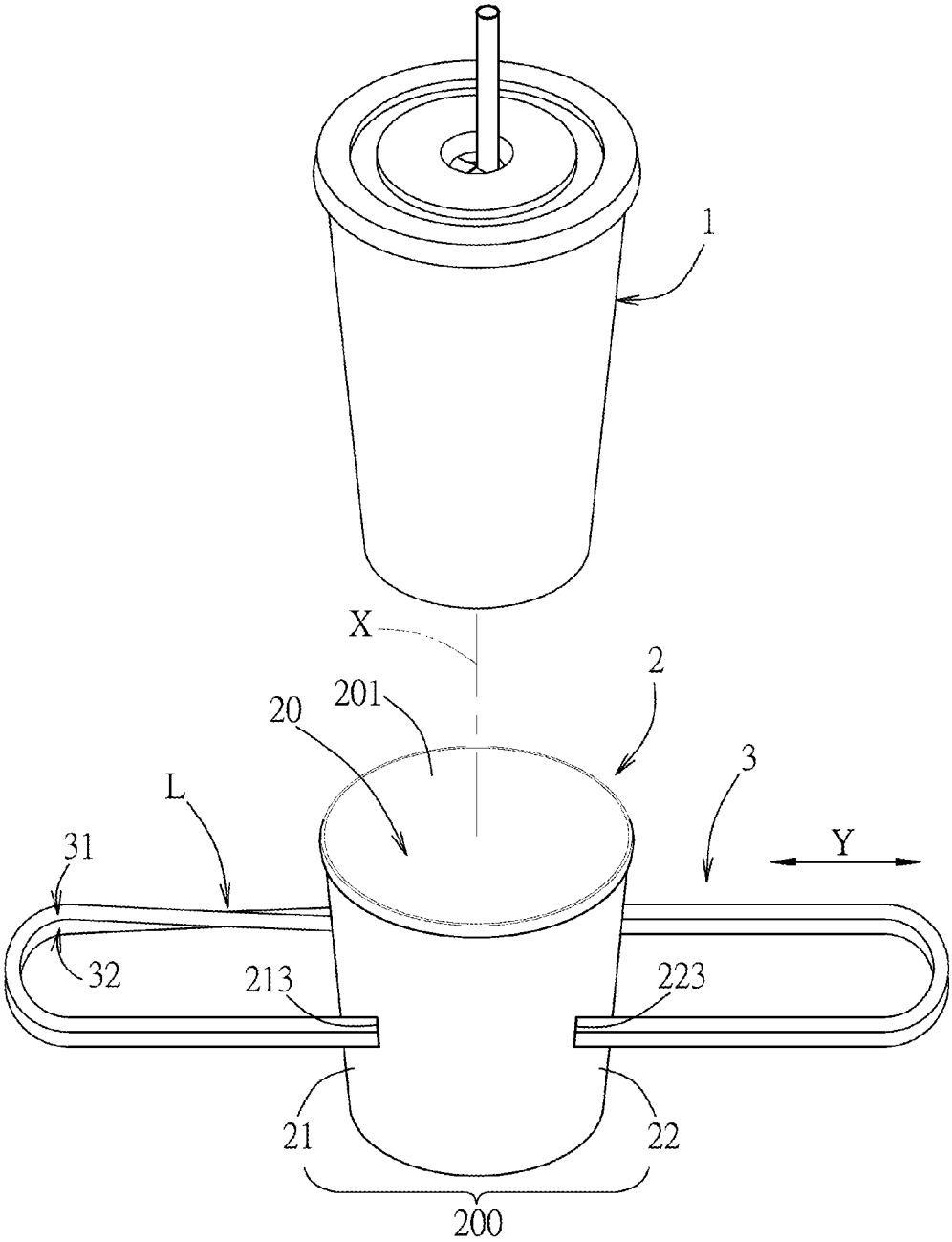
FIG. 1 is a perspective view of the first preferred embodiment of a portable cup holder according to the present invention for holding a cup.

Before the present invention is described in greater detail with reference to the accompanying preferred embodiments, it should be noted herein that like elements are denoted by the same reference numerals throughout the disclosure.

Figure 2:
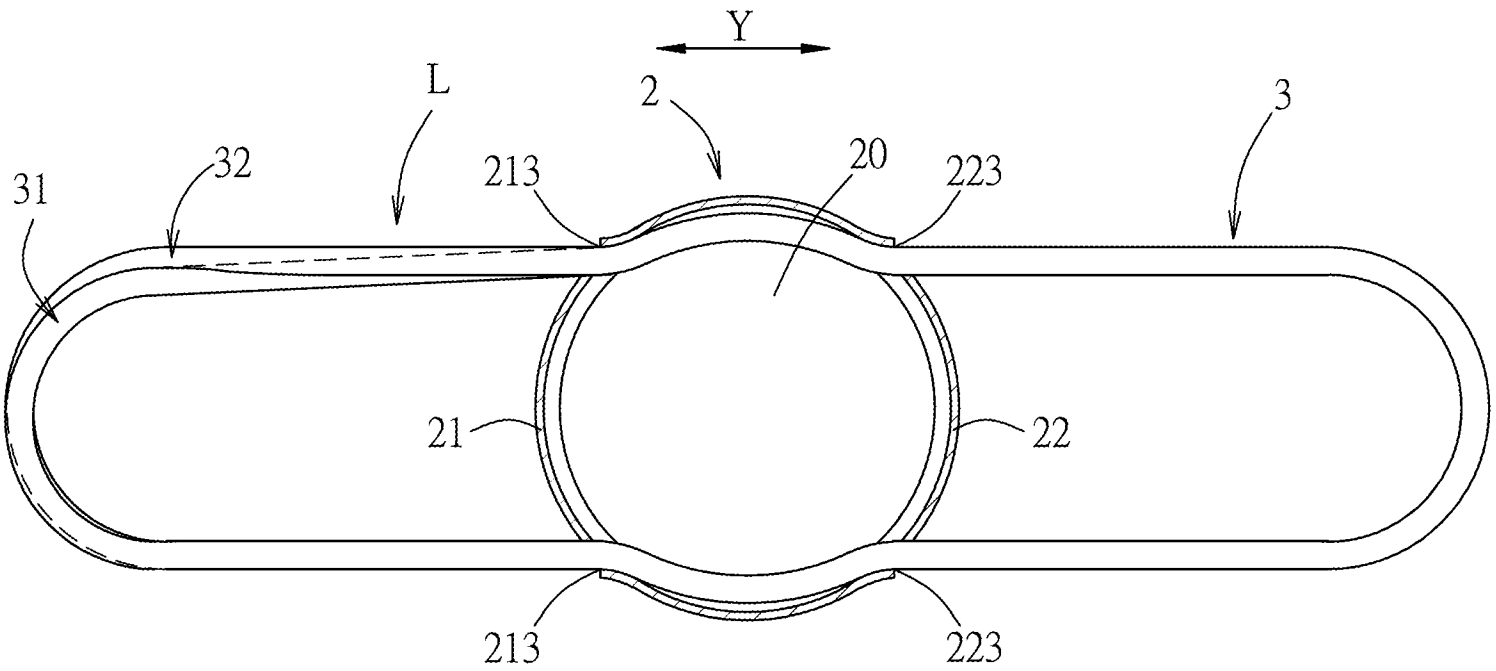
FIG. 2 is a sectional view illustrating a state where first and second string parts of the first preferred embodiment are disposed at a first position.
Figure 3:
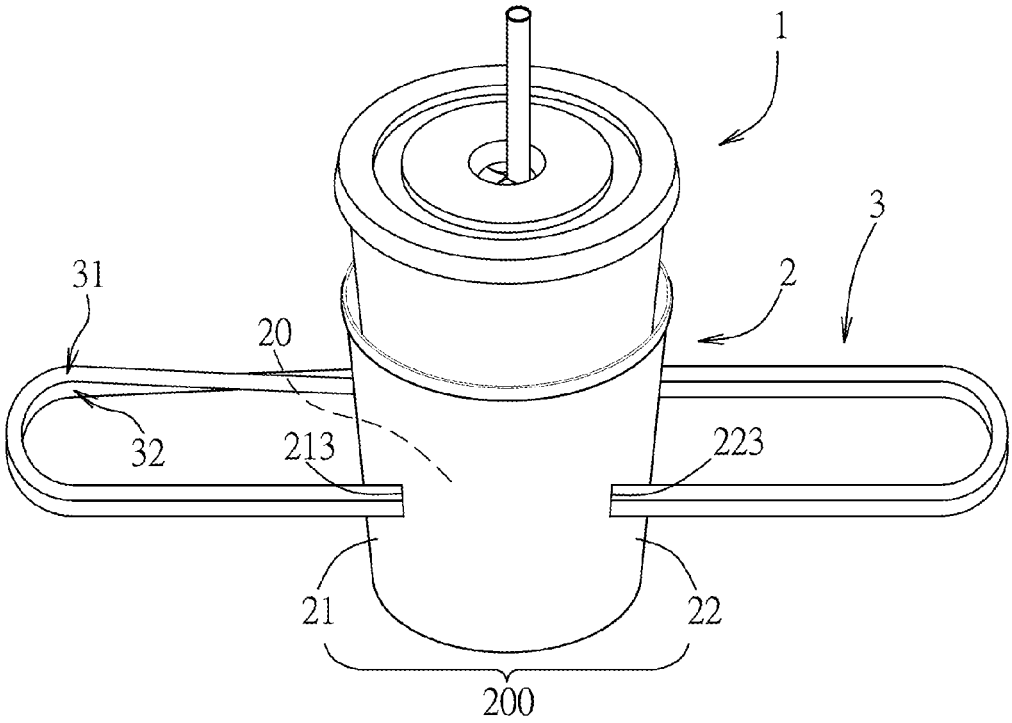
FIG. 3 is a perspective view illustrating the state where the first and second string parts of the first preferred embodiment are disposed at the first position.

FIGS. 1 to 3 illustrate the first preferred embodiment of a portable cup holder according to the present invention. The cup holder includes a cup-holding unit 2 including curved first and second cup-embracing walls 21, 22 that are diametrically disposed with respect to a central axis (X) of the cup-holding unit 2. The cup-holding unit 2 defines a cup-holding space 20 between the first and second cup-embracing walls 21, 22, and a top opening 201 that is in spatial communication with the cup-holding space 20 and that is adapted for extension of a cup 1 therethrough and into the cup-holding space 20. The first cup-embracing wall 21 is formed with a pair of spaced-apart first wall holes 213 that are spaced apart from the top opening 201, and the second cup-embracing wall 22 is formed with a pair of spaced-apart second wall holes 223 that are spaced apart from the top opening 201 and that are aligned with the first wall holes 213 along a transverse direction (Y), respectively. The cup holder further includes a handle string unit 3 including first and second string parts 31, 32, each of which is formed into a loop-shaped structure and each of which extends from outside of the cup-holding space 20 through one of the first wall holes 213 into the cup-holding space 20 and then through one of the second wall holes 223 to the outside of the cup-holding space 20 and then continuously extends therefrom through the other of the second wall holes 223 into the cup-holding space 20 and then through the other of the first wall holes 213 to the outside of the cup-holding space 20. Each of the first and second string parts 31, 32 is shiftable relative to the cup-holding unit 2 along the transverse direction (Y), and substantially maintains a constant overall length along the transverse direction (Y) when shifting along the transverse direction (Y).

In this embodiment, the first and second string parts 31, 32 are stacked on each other at least at a location within the cup-holding space 20, and intersect each other at a location (L) outside of the cup-holding space 20, thereby cooperatively forming a folded and continuously extending endless string.

Figure 4:
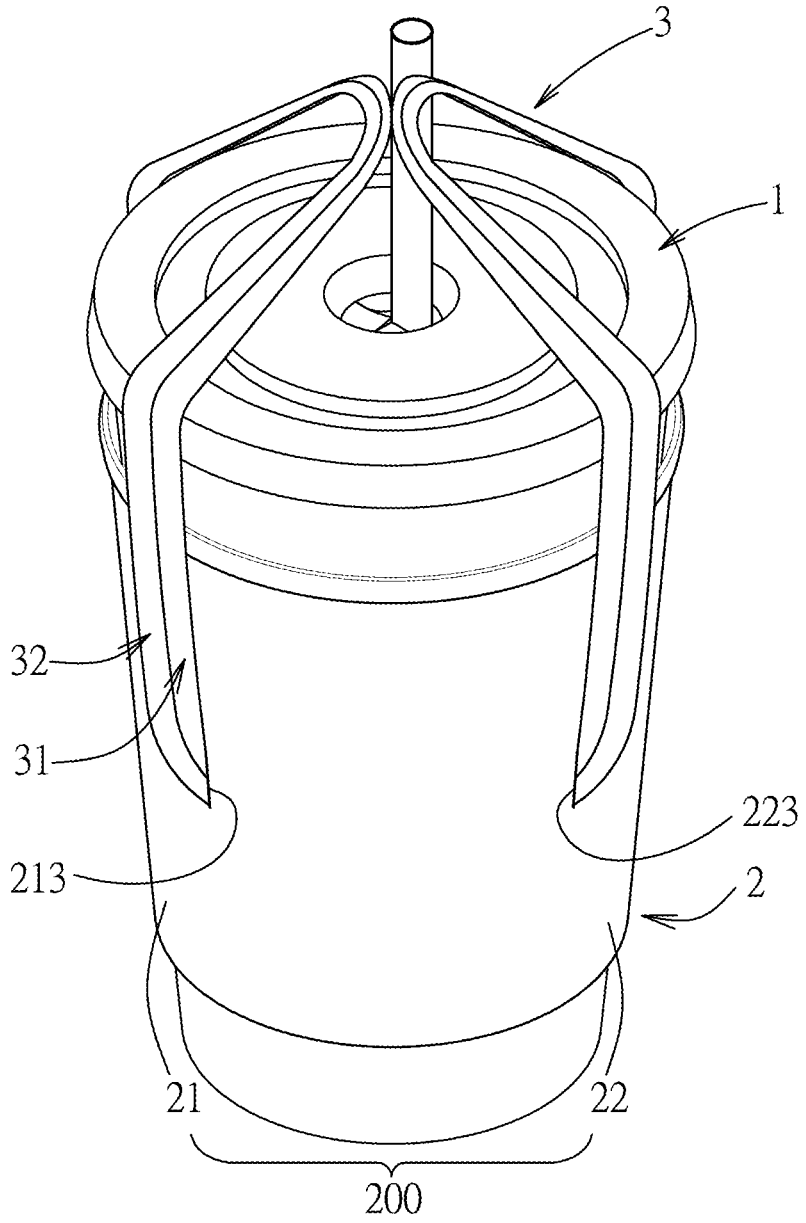
FIG. 4 is a perspective view illustrating a state where the first and second string parts of the first preferred embodiment are extended above the cup with the first and second string parts being disposed at the first position.
Figure 5:
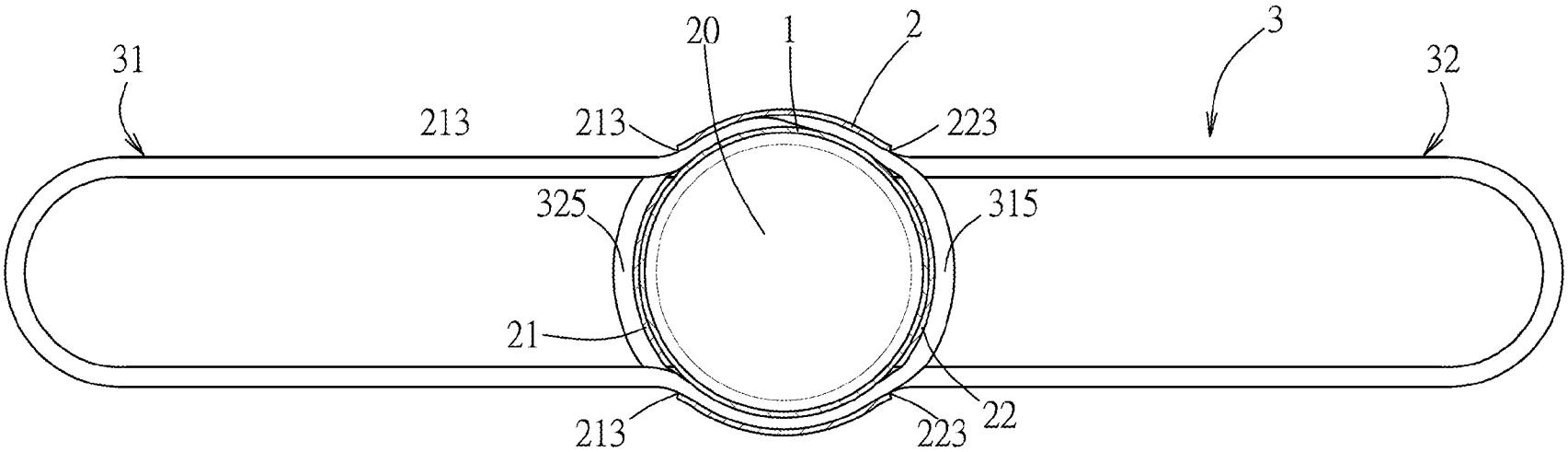
FIG. 5 is a sectional view illustrating another state where the first and second string parts of the first preferred embodiment are disposed at a second position.
Figure 6:
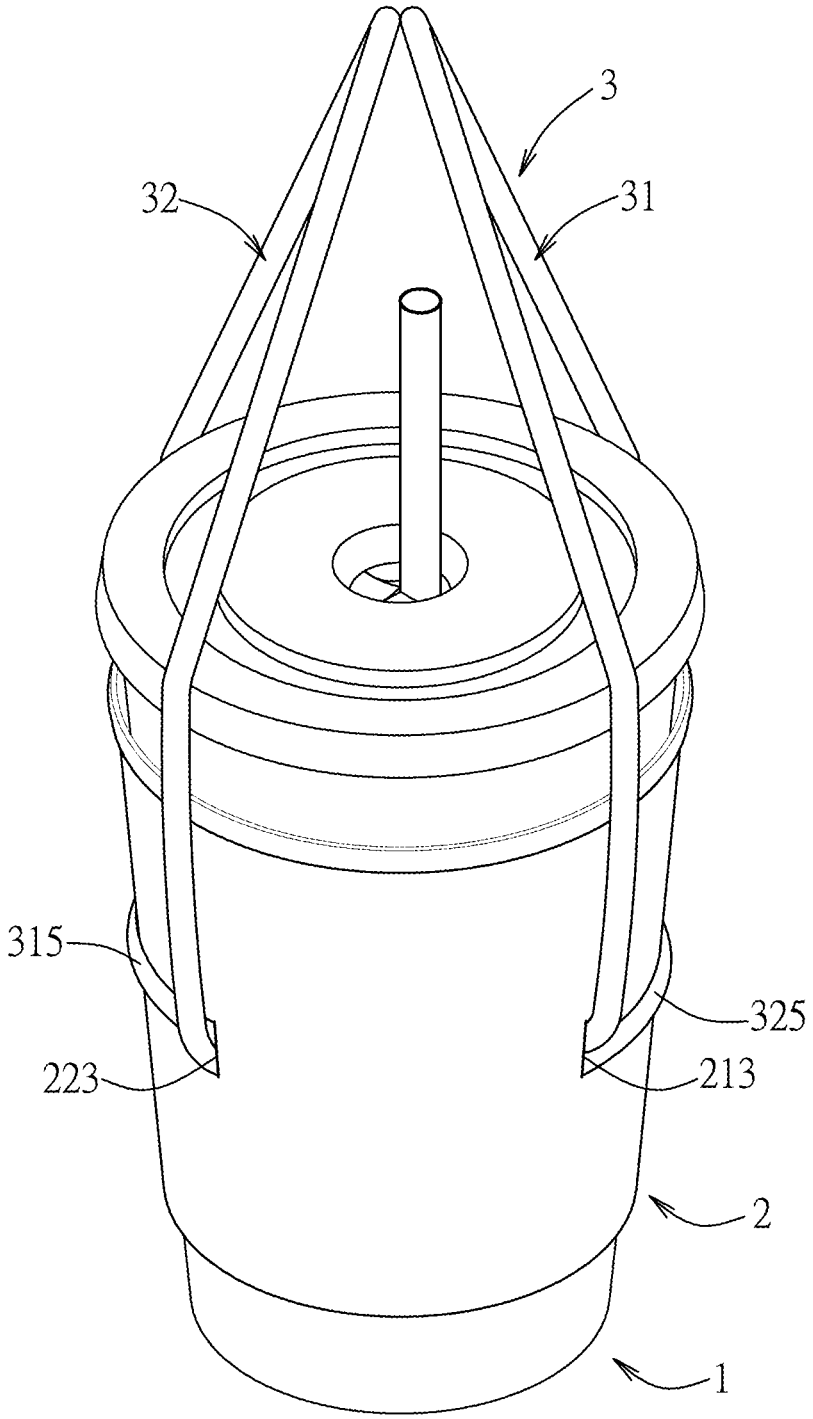
FIG. 6 is a perspective view illustrating the another state where the first and second string parts of the first preferred embodiment are extended over the cup with the first and second string parts being disposed at the second position.

Each of the first and second string parts 31, 32 is shiftable along the transverse direction (Y) between a first position (see FIGS. 1 to 3), where the entire first string part 31 substantially overlaps the second string part 32 in length along a direction parallel to the central axis (X), and a second position (see FIG. 5), where each of the first and second string parts 31, 32 has a portion 315, 325 that is disposed outwardly of the cup-holding space 20 and that embraces a respective one of the first and second cup-embracing walls 21, 22. As shown in FIG. 4, the first and second string parts 31, 32 are disposed at the first position, and are extended over the cup 1. As shown in FIG. 6, the first and second string parts 31, 32 are disposed at the second position and are extended above the cup 1 at a height much greater than that of the first and second string parts 31, 32 depicted in FIG. 4.

In this embodiment, the first and second cup-embracing walls 21, 22 are integrally formed into a circumferentially endless funnel-shaped structure 200 (see FIG. 1).

Figure 7:
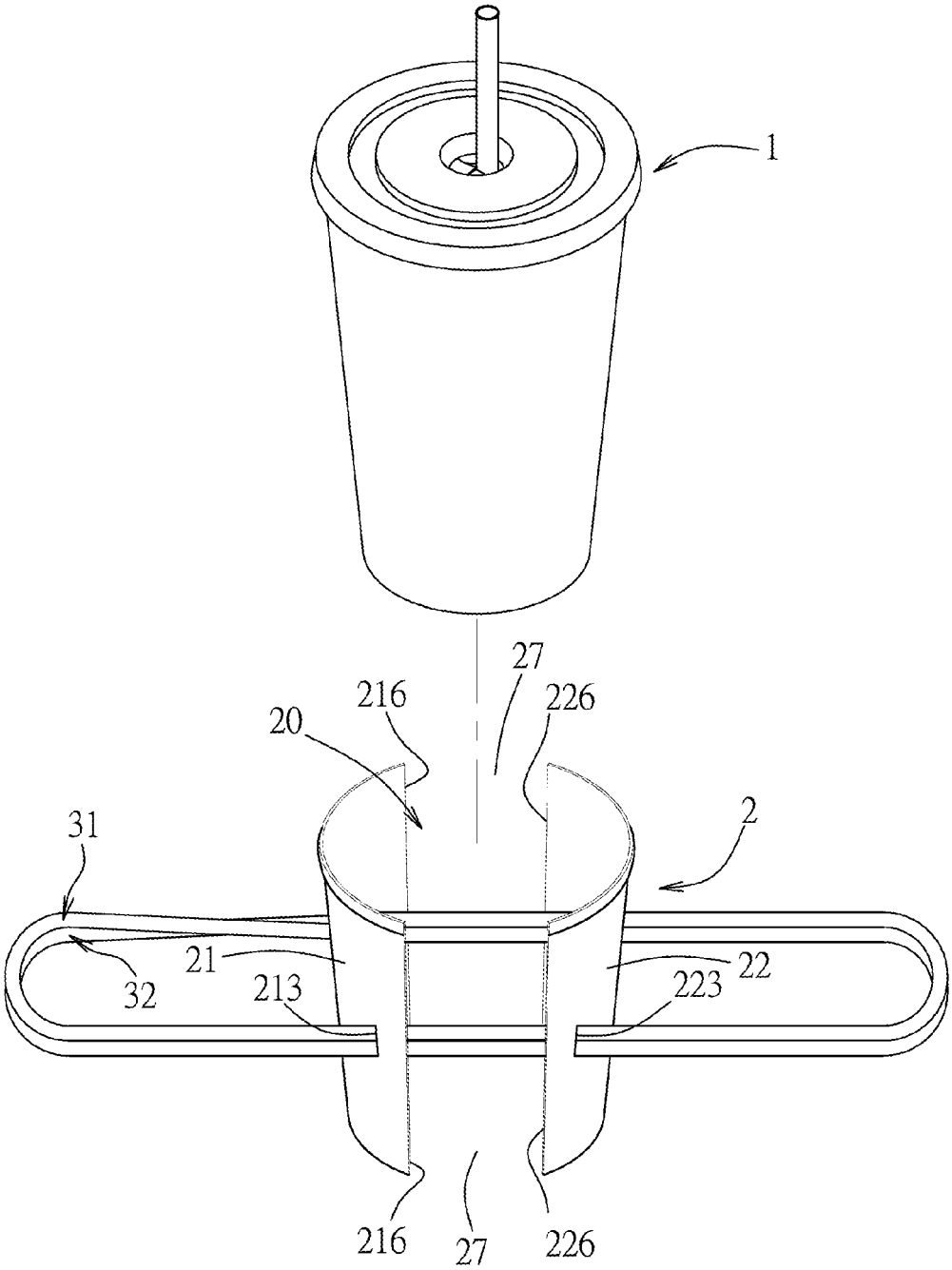
FIG. 7 is a perspective view of the second preferred embodiment of the portable cup holder according to the present invention for holding a cup.
Figure 8:
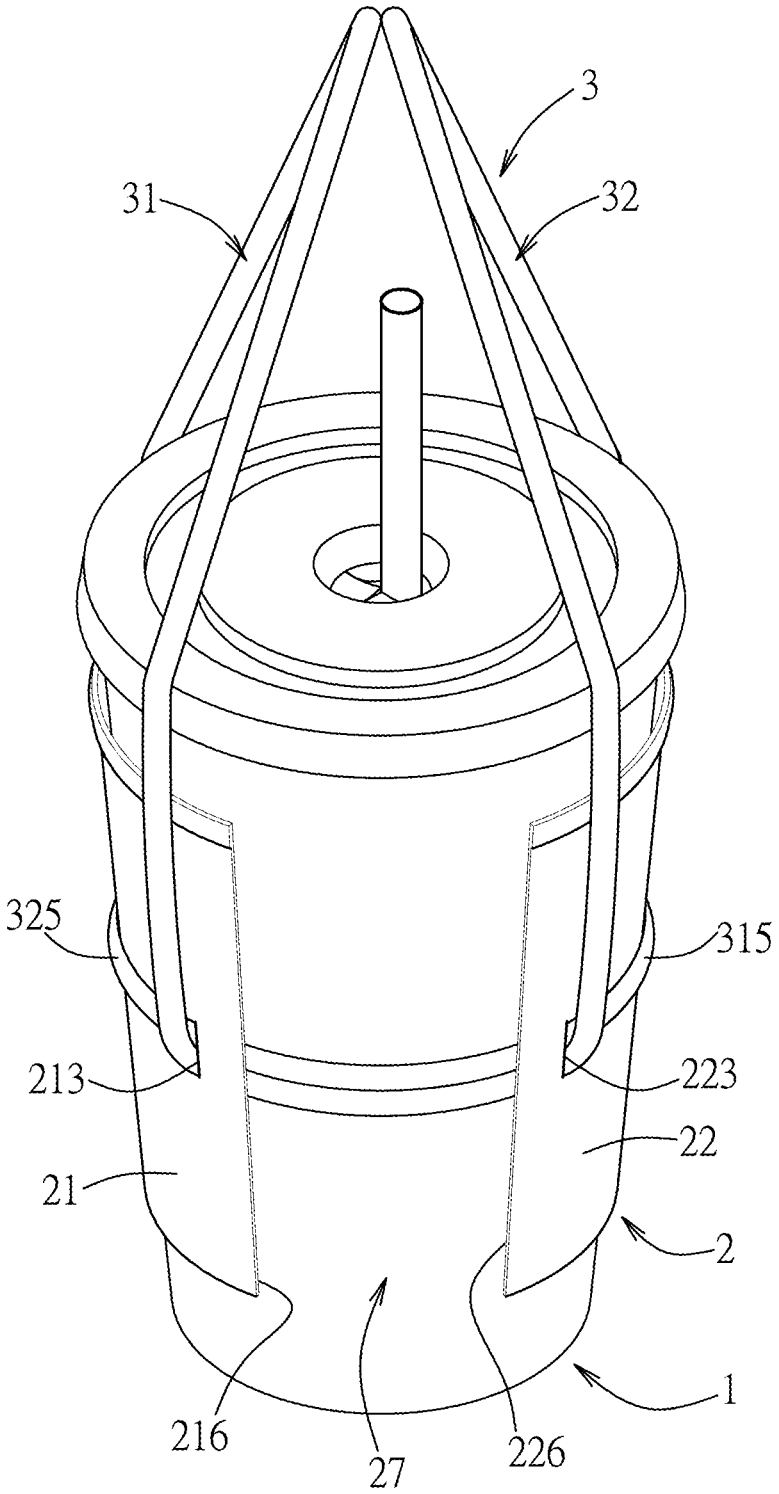
FIG. 8 is a perspective view illustrating a state where the first and second string parts of the second preferred embodiment are extended above the cup.

FIGS. 7 and 8 illustrate the second preferred embodiment of the portable cup holder according to the present invention. The second preferred embodiment differs from the previous embodiment in that the first and second cup-embracing walls 21, 22 are separated from each other, that each of the first and second cup-embracing walls 21, 22 has two opposite circumferential ends 216, 226, and that each of the circumferential ends 216 of the first cup-embracing wall 21 is circumferentially spaced apart from an adjacent one of the circumferential ends 226 of the second cup-embracing wall 22 by a gap 27.

Figure 9:
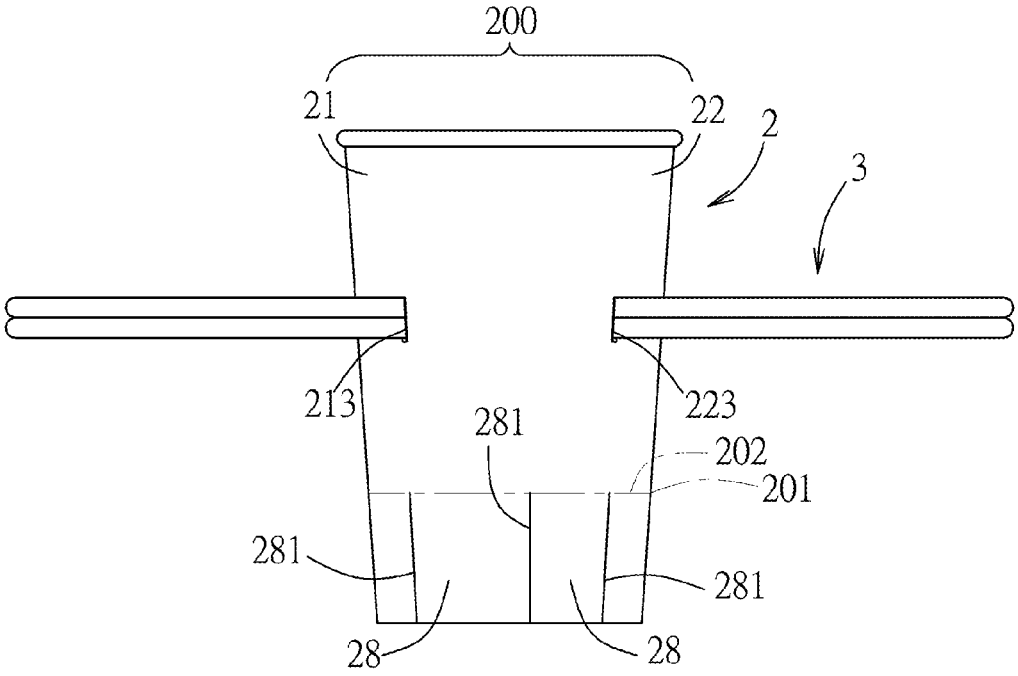
FIG. 9 is a schematic view of the third preferred embodiment of the portable cup holder according to the present invention, illustrating a state where flaps of a cup-holding unit are disposed at a non-folded position.
Figure 10:
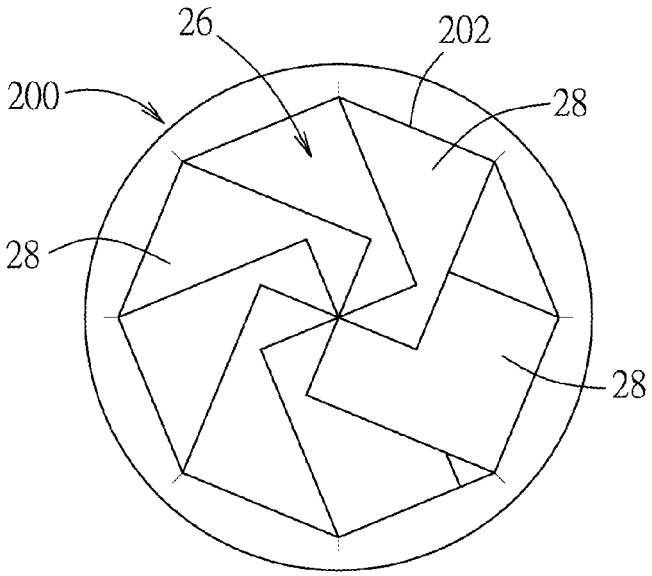
FIG. 10 is a schematic top view illustrating another state where the flaps of the cup-holding unit of the third preferred embodiment are disposed at a folded position.

FIGS. 9 and 10 illustrate the third preferred embodiment of the portable cup holder according to the present invention. The third preferred embodiment differs from the first preferred embodiment in that the funnel-shaped structure 200 has a lower folding line 201 which defines a lower opening 202, and that the cup-holding unit 2 further includes a plurality of separated flaps 28 divided by tear lines 281 and extending from the lower folding line 201 of the funnel-shaped structure 200. The flaps 28 are foldable relative to the funnel-shaped structure 200 between a non-folded position (see FIG. 9) and a folded position (see FIG. 10), where the flaps 28 cooperatively form a bottom wall 26 that covers the lower opening 202.

Figure 11:
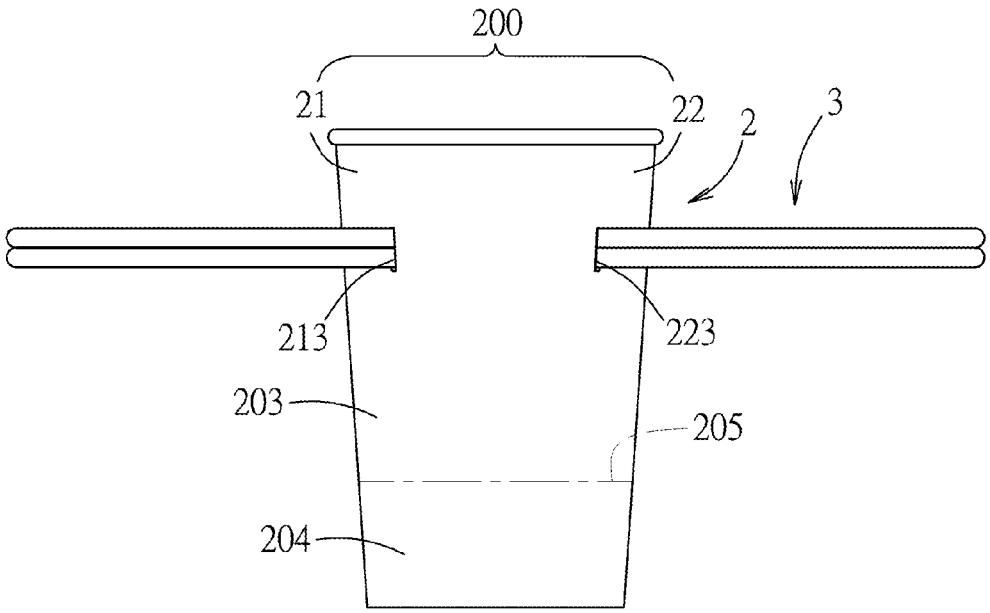
FIG. 11 is a schematic view of the fourth preferred embodiment of the portable cup holder according to the present invention, illustrating a state where a lower end portion of a funnel-shaped structure is disposed at a non-folded position.
Figure 12:
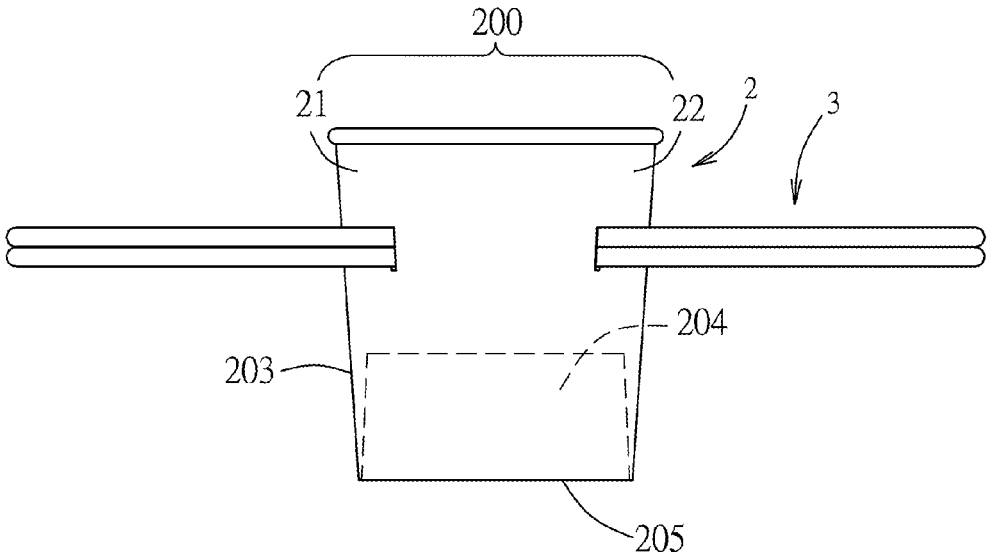
FIG. 12 is a schematic view illustrating another state where the lower end portion of the funnel-shaped structure of the fourth preferred embodiment is disposed at a folded position.

FIGS. 11 and 12 illustrate the fourth preferred embodiment of the portable cup holder according to the present invention. The fourth preferred embodiment differs from the first preferred embodiment in that the funnel-shaped structure 200 has upper and lower end portions 203, 204 and a folding line 205 that divides the upper and lower end portions 203, 204 from each other, and that the lower end portion 204 is foldable relative to the upper end portion 203 between a non-folded position (see FIG. 11), where the lower end portion 204 extends downwardly from the folding line 205, and a folded position (see FIG. 12), where the lower end portion 204 is disposed in and surrounded by the upper end portion 203 so as to form an inner sleeve inside the upper end portion 203 for surrounding and contacting the cup 1 (not shown).

With the inclusion of the loop-shaped first and second string parts 31, 32 in the portable cup holder of the present invention and the extension of the first and second string parts 31, 32 through the first and second wall holes 213, 223 that are spaced apart from the top opening 201, the aforesaid drawbacks associated with the prior art can be overcome. In addition, by shifting the first and second string parts 31, 32 to the second position to allow the portions 315, 325 of the first and second string parts 31, 32 to abut respectively against the second and first cup-embracing walls 22, 21, the cup 1 held in the cup-holding unit 2 can be firmly held in an upright position.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A portable cup holder comprising:

a cup-holding unit including curved first and second cup-embracing walls that are diametrically disposed with respect to a central axis of said cup-holding unit, said cup-holding unit defining a cup-holding space between said first and second cup-embracing walls, and a top opening that is in spatial communication with said cup-holding space and that is adapted for extension of a cup therethrough and into said cup-holding space, said first cup-embracing wall being formed with a pair of spaced-apart first wall holes that are spaced apart from said top opening, said second cup-embracing wall being formed with a pair of spaced-apart second wall holes that are spaced apart from said top opening and that are aligned with said first wall holes along a transverse direction, respectively; and a handle string unit including first and second string parts, each of which is formed into a loop-shaped structure and each of which extends from outside of said cup-holding space through one of said first wall holes into said cup-holding space and then through one of said second wall holes to the outside of said cup-holding space and then continuously extends therefrom through the other of said second wall holes into said cup-holding space and then through the other of said first wall holes to the outside of said cup-holding space;

wherein each of said first and second string parts is shiftable relative to said cup-holding unit along the transverse direction;

wherein said first and second string parts are stacked on each other at least at a location within said cup-holding space, and intersect each other at a location outside of said cup-holding space, thereby cooperatively forming a folded and continuously extending endless string.

2. The portable cup holder of claim 1, wherein each of said first and second string parts is shiftable along the transverse direction to a position, in which each of said first and second string parts has a portion that is disposed outwardly of said cup-holding space and that embraces a respective one of said first and second cup-embracing walls.

3. The portable cup holder of claim 1, wherein each of said first and second cup-embracing walls has two opposite circumferential ends, each of said circumferential ends of said first cup-embracing wall being circumferentially spaced apart from an adjacent one of said circumferential ends of said second cup-embracing wall by a gap.

4. The portable cup holder of claim 1, wherein said first and second cup-embracing walls are integrally formed into a funnel-shaped structure.

5. The portable cup holder of claim 4, wherein said funnel-shaped structure has a lower folding line that defines a lower opening, said cup-holding unit further including a plurality of separated flaps extending from said lower folding line, said flaps being foldable relative to said funnel-shaped structure to a folded position, where said flaps cooperatively form a bottom wall that covers said lower opening.

6. The portable cup holder of claim 4, wherein said funnel-shaped structure has upper and lower end portions and a folding line that divides said upper and lower end portions from each other, said lower end portion being foldable relative to said upper end portion between a non-folded position, where said lower end portion extends downwardly from said folding line, and a folded position, where said lower end portion is disposed in and surrounded by said upper end portion.

* * * * *